US009540089B2

(12) United States Patent
Oguma et al.

(10) Patent No.: US 9,540,089 B2
(45) Date of Patent: Jan. 10, 2017

(54) MARINE PROPULSION DEVICE

(71) Applicant: YAMAHA HATSUDOKI KABUSHIKI KAISHA, Iwata-shi, Shizuoka (JP)

(72) Inventors: Takahiro Oguma, Shizuoka (JP); Atsushi Kumita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 66 days.

(21) Appl. No.: 14/641,563

(22) Filed: Mar. 9, 2015

(65) Prior Publication Data

US 2015/0367925 A1 Dec. 24, 2015

(30) Foreign Application Priority Data

Jun. 20, 2014 (JP) ..... 2014-127146

(51) Int. Cl.
*B63H 20/28* (2006.01)
*B63H 20/20* (2006.01)

(52) U.S. Cl.
CPC ..... *B63H 20/28* (2013.01); *B63H 20/20* (2013.01)

(58) Field of Classification Search
CPC ..... B63H 20/28; B63H 20/20; F01P 3/202
USPC ..... 440/88 C, 88 M
See application file for complete search history.

(56) References Cited

U.S. PATENT DOCUMENTS

2011/0195620 A1* 8/2011 Davis ..... B63H 20/14 440/75
2013/0149920 A1 6/2013 Sugiyama

FOREIGN PATENT DOCUMENTS

JP 63-200618 U 12/1988
JP 2013-107538 A 6/2013

* cited by examiner

*Primary Examiner* — Anthony Wiest
(74) *Attorney, Agent, or Firm* — Keating and Bennett, LLP

(57) ABSTRACT

A marine propulsion device includes an engine, a driving shaft coupled to the engine and configured to transmit power, a first cooling water pump configured to be driven by the driving force of the driving shaft and to pump cooling water to cool the engine, a cooling water path configured to supply the cooling water sent by the first cooling water pump to the engine, and a pressurization mechanism arranged in a water passage upstream of a suction port of the first cooling water pump and configured to apply pressure to the cooling water supplied to the suction port of the first cooling water pump.

18 Claims, 5 Drawing Sheets

MARINE PROPULSION DEVICE

CROSS-REFERENCE TO RELATED APPLICATION

This application claims priority to Patent Application No. 2014-127146 filed in Japan on Jun. 20, 2014, the entire contents of which are hereby incorporated by reference.

BACKGROUND OF THE INVENTION

1. Field of the Invention

The present invention relates to a marine propulsion device, and more particularly, it relates to a marine propulsion device including a cooling water pump configured to pump cooling water to cool an engine.

2. Description of the Related Art

A marine propulsion device including a cooling water pump configured to pump cooling water to cool an engine is known in general. Such a marine propulsion device is disclosed in Japanese Patent Laying-Open No. 2013-107538, for example.

Japanese Patent Laying-Open No. 2013-107538 discloses an outboard motor (marine propulsion device) including an engine, a drive shaft coupled to the engine and configured to transmit power, and a cooling water pump configured to be driven by rotation of the drive shaft and to pump cooling water to cool the engine. In the outboard motor according to Japanese Patent Laying-Open No. 2013-107538, a main water intake and a subordinate water intake are provided, and water taken in from both of the water intakes is combined in a common cooling channel such that the degree of freedom of the layout of a cooling water path is ensured, and the efficiency of supplying water to the cooling water pump is enhanced.

In the outboard motor (marine propulsion device) according to Japanese Patent Laying-Open No. 2013-107538, the efficiency of supplying water to the cooling water pump is enhanced, but the amount of cooling water discharged from the cooling water pump is restricted by the pump capacity so that the amount of cooling water discharged from the cooling water pump cannot be increased even in the case where the capacity of the cooling channel on the upstream side with respect to the cooling water pump is increased.

Therefore, it has been proposed to increase the pump capacity of the cooling water pump to increase the discharge rate of the cooling water.

In the case where the length of the cooling water pump in a radial direction is increased to increase the pump capacity, however, the speed of an outer peripheral portion of the cooling water pump is increased so that cavitation is easily generated. Consequently, an increase in the amount of discharge (flow rate) is hindered, and the durability of the cooling water pump is reduced by erosion. Therefore, it is difficult to increase the amount of discharge of the cooling water while maintaining the durability of the cooling water pump.

SUMMARY OF THE INVENTION

Preferred embodiments of the present invention provide a marine propulsion device that increases the amount of discharged cooling water while maintaining the durability of a cooling water pump.

A marine propulsion device according to a first preferred embodiment of the present invention includes an engine, a driving shaft coupled to the engine and configured to transmit power, a first cooling water pump configured to be driven by the driving force of the driving shaft and to pump cooling water to cool the engine, a cooling water path configured to supply the cooling water pumped by the first cooling water pump to the engine, and a pressurization mechanism arranged in a water passage upstream of a suction port of the first cooling water pump and configured to apply pressure to the cooling water supplied to the suction port of the first cooling water pump.

In the marine propulsion device according to the first preferred embodiment, the pressurization mechanism configured to apply pressure to the cooling water supplied to the suction port of the first cooling water pump is provided in the water passage upstream of the suction port of the first cooling water pump such that the total power of the first cooling water pump and the pressurization mechanism that send the cooling water is increased by providing the pressurization mechanism without increasing the pump capacity of the first cooling water pump. Thus, the amount of discharged cooling water is increased. Furthermore, the pump capacity of the first cooling water pump is not increased, and hence the cooling water pump is not increased in size in a radial direction. Therefore, an excessive increase in the flow velocity of the cooling water in an outer peripheral portion of the cooling water pump is significantly reduced, and hence generation of cavitation is significantly reduced or prevented. Thus, a hindrance to increasing the amount of discharged cooling water is significantly reduced or prevented, and a reduction in the durability of the cooling water pump resulting from erosion is significantly reduced or prevented. Consequently, the amount of discharged cooling water is increased while the durability of the cooling water pump is maintained. In addition, the pressurization mechanism is provided such that the pressure of the cooling water sent to the first cooling water pump is increased, and hence generation of cavitation is effectively reduced or prevented. Consequently, in the case where the number of rotations of the first cooling water pump is increased, the flow rate is easily increased, and erosion resulting from generation of cavitation is effectively prevented.

In the marine propulsion device according to the first preferred embodiment, the pressurization mechanism preferably includes a rotating body driven by the driving force of the driving shaft. According to this structure, the pressurization mechanism easily applies pressure to the cooling water utilizing the driving force of the driving shaft and without providing a separate drive source for the pressurization mechanism.

In this case, the rotating body of the pressurization mechanism preferably includes a vaned wheel. According to this structure, the pressurization mechanism easily applies pressure to the cooling water by the vaned wheel.

In the structure described above in which the rotating body of the pressurization mechanism includes the vaned wheel, the first cooling water pump preferably includes an impeller made of rubber, for example, and the vaned wheel of the pressurization mechanism is preferably made of a material harder than the rubber of the impeller of the first cooling water pump. According to this structure, the vaned wheel of the pressurization mechanism is made of the material harder than the material of the impeller such that the durability of the pressurization mechanism is improved, and hence damage of the vaned wheel resulting from erosion is significantly reduced or prevented even when cavitation is generated in the vicinity of a suction port of the pressurization mechanism.

In this case, the vaned wheel of the pressurization mechanism is preferably made of resin other than rubber, or made of metal, for example. According to this structure, the durability of the vaned wheel of the pressurization mechanism is effectively improved.

In the structure described above in which the pressurization mechanism includes the rotating body, the pressurization mechanism preferably includes a second cooling water pump configured to apply pressure to the cooling water by rotation of the rotating body. According to this structure, the amount of discharged cooling water is effectively increased by a plurality of cooling water pumps serially coupled to each other.

In the structure described above in which the pressurization mechanism includes the rotating body, the rotating body of the pressurization mechanism is preferably configured to rotate coaxially with an impeller of the first cooling water pump. According to this structure, the drive axis of the pressurization mechanism and the drive axis of the first cooling water pump are in common with each other, and hence an increase in the number of components is significantly reduced unlike the case where the drive axes are provided separately from each other.

In the structure described above in which the pressurization mechanism includes the rotating body, a suction port of the pressurization mechanism is preferably arranged to extend in the axial direction of the rotating body. According to this structure, the cooling water efficiently flows into the pressurization mechanism from the vicinity of the axial center (rotation axis) where the centrifugal force is small.

In the structure described above in which the pressurization mechanism includes the rotating body, a discharge port of the pressurization mechanism is preferably located in an outer peripheral portion of the pressurization mechanism. According to this structure, the cooling water is efficiently discharged from the outer peripheral portion where the centrifugal force is large.

In the structure described above in which the pressurization mechanism includes the rotating body, the suction port of the first cooling water pump is preferably located in an outer peripheral portion of the first cooling water pump. According to this structure, the cooling water is allowed to flow into the first cooling water pump through the outer peripheral portion of the first cooling water pump when the cooling water is discharged from the outer peripheral portion of the pressurization mechanism, and hence the structure of a path (flow path) for the cooling water is simplified.

In the structure described above in which the discharge port of the pressurization mechanism is located in the outer peripheral portion of the pressurization mechanism, a housing of the pressurization mechanism and a housing of the first cooling water pump are preferably provided with a path allowing the discharge port of the pressurization mechanism and the suction port of the first cooling water pump to communicate with each other. According to this structure, the path for the cooling water is preferably integral with the housing of the pressurization mechanism and the housing of the first cooling water pump, and hence an increase in the number of components is significantly reduced or prevented.

In the structure described above in which the pressurization mechanism includes the rotating body, the first cooling water pump preferably includes an impeller configured to rotate in an eccentric manner, and the center of a rotation region of the impeller which is eccentric in the first cooling water pump and the center of a rotation region of the rotating body in the pressurization mechanism are preferably deviated from each other in a plan view. According to this structure, the center of the rotation region of the impeller which is eccentric in the first cooling water pump and the center of the rotation region of the rotating body in the pressurization mechanism are deviated from each other by an eccentricity such that the axis of the impeller of the eccentric pump (first cooling water pump) and the axis of the rotating body of the pressurization mechanism are aligned with each other. Consequently, the first cooling water pump and the pressurization mechanism are easily driven coaxially.

In the marine propulsion device according to the first preferred embodiment, the first cooling water pump and the pressurization mechanism are preferably arranged in a vertical direction to overlap each other in a plan view. According to this structure, enlargement of the regions occupied by the first cooling water pump and the pressurization mechanism are significantly reduced or prevented in the plan view of the marine propulsion device, and hence enlargement of the marine propulsion device in the plan view is significantly reduced or prevented.

In this case, the pressurization mechanism is preferably arranged below the first cooling water pump. According to this structure, in the case where the cooling water is sucked up from the lower side and is supplied to the upper side, the path (flow path) for the cooling water from the pressurization mechanism to the first cooling water pump is provided from the lower side toward the upper side without meandering in the vertical direction, and hence an increase in the length of the flow path for the cooling water is significantly reduced or prevented. Thus, an increase in pressure loss is significantly reduced or prevented, and hence the flow rate of the cooling water is more effectively increased.

In the marine propulsion device according to the first preferred embodiment, the first cooling water pump and the pressurization mechanism are preferably arranged on the upper surface of a lower case of the marine propulsion device. According to this structure, during assembly or maintenance of the marine propulsion device, operations on the first cooling water pump and the pressurization mechanism are easily performed in a state where the lower case is detached.

In this case, the pressurization mechanism is preferably arranged between the lower case of the marine propulsion device and the first cooling water pump. According to this structure, the pressurization mechanism is easily arranged below the first cooling water pump.

In the structure described above in which the first cooling water pump and the pressurization mechanism are arranged on the upper surface of the lower case of the marine propulsion device, the first cooling water pump and the pressurization mechanism are preferably fixed to the upper surface of the lower case of the marine propulsion device by a common fastener member in a state where the first cooling water pump and the pressurization mechanism are stacked in a vertical direction. According to this structure, the first cooling water pump and the pressurization mechanism are easily mounted to each other, and hence a mounting operation is simplified.

A marine propulsion device according to a second preferred embodiment of the present invention includes an engine, a driving shaft coupled to the engine and configured to transmit power, a cooling water pump configured to be driven by the driving force of the driving shaft and to pump cooling water to cool the engine, a cooling water path configured to supply the cooling water pumped by the cooling water pump to the engine, and a vaned wheel arranged in a water passage upstream of a suction port of the cooling water pump.

In the marine propulsion device according to the second preferred embodiment, the vaned wheel is provided in the water passage upstream of the suction port of the cooling water pump such that the total power of the cooling water pump and the vaned wheel pumping the cooling water is increased by providing the vaned wheel without increasing the pump capacity of the cooling water pump. Thus, the amount of discharged cooling water is increased. Furthermore, the pump capacity of the cooling water pump is not increased, and hence the cooling water pump is not increased in size in a radial direction. Therefore, an excessive increase in the flow velocity of the cooling water in an outer peripheral portion of the cooling water pump is significantly reduced or prevented, and hence generation of cavitation is significantly reduced or prevented. Thus, a hindrance to increasing the amount of discharged cooling water is significantly reduced or prevented, and a reduction in the durability of the cooling water pump resulting from erosion is significantly reduced or prevented. Consequently, the amount of discharged cooling water is increased while the durability of the cooling water pump is maintained. In addition, the vaned wheel is provided such that the pressure of the cooling water sent to the cooling water pump is increased, and hence generation of cavitation is significantly reduced or prevented. Consequently, in the case where the number of rotations of the cooling water pump is increased, the flow rate is easily increased, and erosion resulting from generation of cavitation is effectively prevented.

A marine propulsion device according to a third preferred embodiment of the present invention includes an engine, a driving shaft coupled to the engine and configured to transmit power, a first cooling water pump configured to be driven by the driving force of the driving shaft and to pump cooling water to cool the engine, a cooling water path configured to supply the cooling water pumped by the first cooling water pump to the engine, and a second cooling water pump arranged in a water passage upstream of a suction port of the first cooling water pump.

In the marine propulsion device according to the third preferred embodiment, the second cooling water pump is provided in the water passage upstream of the suction port of the first cooling water pump such that the total power of the first cooling water pump and the second cooling water pump pumping the cooling water is increased by providing the second cooling water pump without increasing the pump capacity of the first cooling water pump. Thus, the amount of discharged cooling water is increased. Furthermore, the pump capacity of each of the cooling water pumps is not increased, and hence each of the cooling water pumps is not increased in size in a radial direction. Therefore, an excessive increase in the flow velocity of the cooling water in outer peripheral portions of the cooling water pumps is significantly reduced or prevented, and hence generation of cavitation is significantly reduced or prevented. Thus, a hindrance to increasing the amount of discharged cooling water is significantly reduced or prevented, and a reduction in the durability of the cooling water pumps resulting from erosion is significantly reduced or prevented. Consequently, the amount of discharged cooling water is increased while the durability of the cooling water pumps is maintained. In addition, the second cooling water pump is provided such that the pressure of the cooling water sent to the first cooling water pump is increased, and hence generation of cavitation is significantly reduced or prevented. Consequently, in the case where the number of rotations of the first cooling water pump is increased, the flow rate is easily increased, and erosion resulting from generation of cavitation is effectively prevented.

According to preferred embodiments of the present invention, as described above, the amount of discharged cooling water is increased while the durability of the cooling water pump(s) is maintained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of an outboard motor 100 according to preferred embodiments of the present invention is now described with reference to FIGS. 1 to 8. In the figures, arrow FWD represents the forward movement direction of a boat, and arrow BWD represents the reverse movement direction of the boat. The outboard motor 100 is an example of the "marine propulsion device" according to a preferred embodiment of the present invention.

Figure 1:
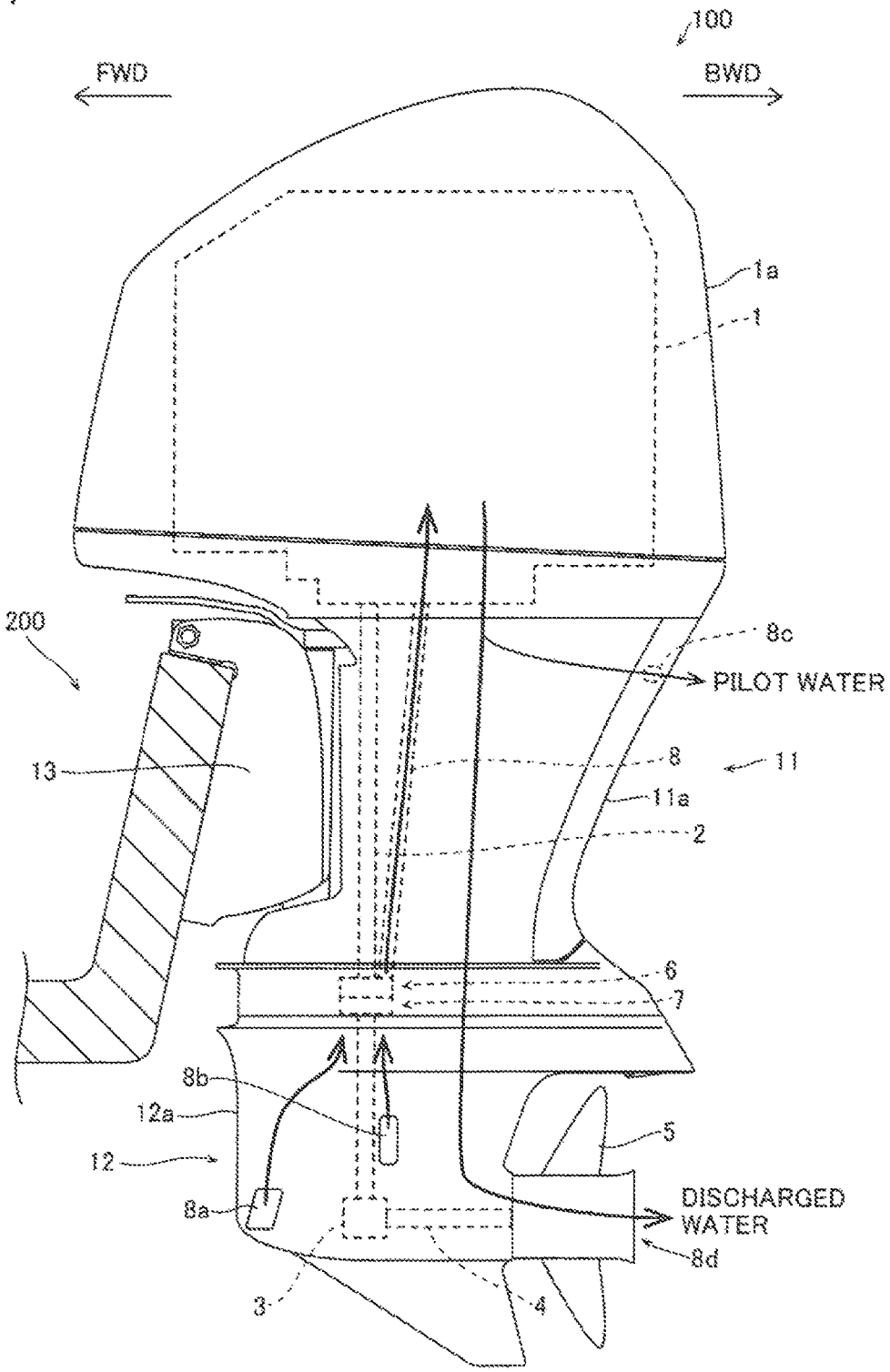
FIG. 1 is a side elevational view showing the overall structure of an outboard motor according to a preferred embodiment of the present invention.

The outboard motor 100 is mounted on a rear portion of a boat body 200, as shown in FIG. 1. The outboard motor 100 includes an engine 1, a drive shaft 2, a gear portion 3, a propeller shaft 4, a propeller 5, a first cooling water pump 6, a second cooling water pump 7, and a cooling water path 8. The outboard motor 100 also includes an upper portion 11 located below the engine 1, a lower portion 12 located below the upper portion 11, and a bracket portion 13 arranged on the front side of the upper portion 11. The upper portion 11 is provided with an upper case 11*a*. The lower portion 12 is provided with a lower case 12*a*. The outboard motor 100 is mounted on the boat body 200 to be rotatable about a vertical axis and a horizontal axis by the bracket portion 13. The drive shaft 2 is an example of "driving shaft" according to a preferred embodiment of the present invention. The second cooling water pump 7 is an example of "pressurization mechanism" according to a preferred embodiment of the present invention.

The engine 1 is provided on the upper side of the outboard motor 100 and includes an internal-combustion engine driven by explosive combustion of gasoline, light oil, or the like. The engine 1 is covered by an engine cover 1*a*.

The drive shaft 2 is coupled to a crankshaft of the engine 1 and configured to transmit the power of the engine 1. The drive shaft 2 is arranged to extend in a vertical or substantially vertical direction. The drive shaft 2 is arranged such that the upper side thereof passes through the upper portion 11 (upper case 11*a*) and the lower side thereof is located in the lower portion 12 (lower case 12*a*).

Figure 2:
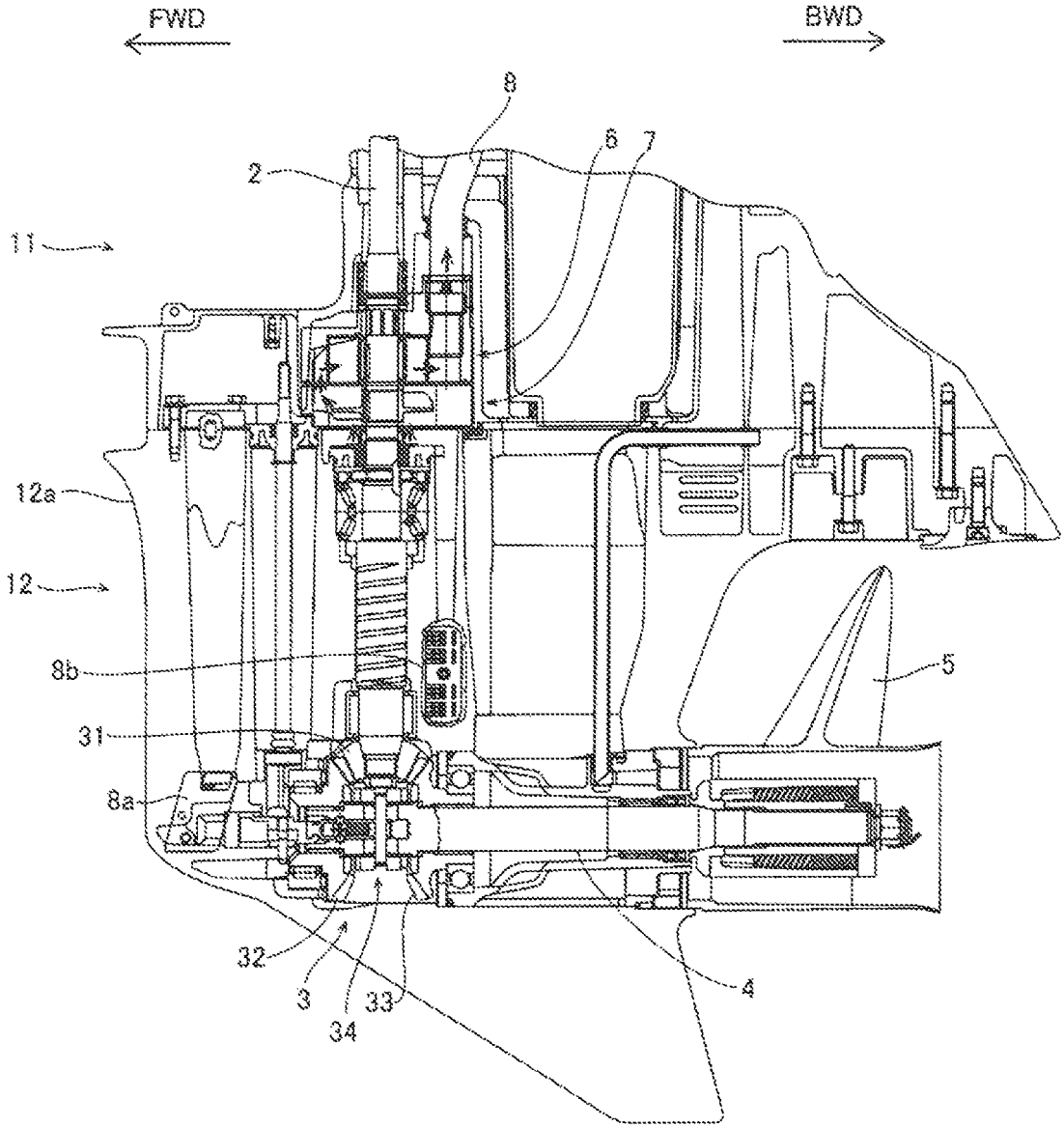
FIG. 2 is a sectional side elevational view showing the vicinity of a lower portion of the outboard motor according to a preferred embodiment of the present invention.

The gear portion 3 is arranged in the lower portion 12 (lower case 12*a*). The gear portion 3 decelerates rotation of the drive shaft 2 and transmits the decelerated rotation to the propeller shaft 4. In other words, the gear portion 3 transmits the driving force of the drive shaft 2 rotating about a rotation axis extending in the vertical or substantially vertical direction to the propeller shaft 4 rotating about a rotation axis extending in a front to back direction. Specifically, the gear portion 3 includes a pinion gear 31, a forward movement bevel gear 32, a reverse movement bevel gear 33, and a dog clutch 34, as shown in FIG. 2. The pinion gear 31 is mounted on a lower end of the drive shaft 2. The forward movement bevel gear 32 and the reverse movement bevel gear 33 are provided in the propeller shaft 4 to hold the pinion gear 31 therebetween. The pinion gear 31 meshes with the forward movement bevel gear 32 and the reverse movement bevel gear 33. The gear portion 3 switches between a state where the dog clutch 34 rotating integrally with the propeller shaft 4 engages with the forward movement bevel gear 32 and a state where the dog clutch 34 rotating integrally with the propeller shaft 4 engages with the reverse movement bevel gear 33 to switch the rotation direction (the forward movement direction and the reverse movement direction) of the propeller shaft 4.

The propeller 5 (screw) is connected to the propeller shaft 4. The propeller 5 is driven to rotate about the rotation axis extending in the front to back direction. The propeller 5 rotates in water to generate thrust force in an axial direction. The propeller 5 moves the boat body 200 forwardly or reversely according to the rotation direction.

The first cooling water pump 6 pumps cooling water to cool the engine 1. Specifically, the first cooling water pump 6 draws in cooling water from the outside and pumps the cooling water to the engine 1. This first cooling water pump 6 is preferably driven by the driving force of the drive shaft 2. The first cooling water pump 6 is arranged on the upper surface of the lower case 12*a*. The first cooling water pump 6 is arranged in the upper case 11*a*.

Figure 3:
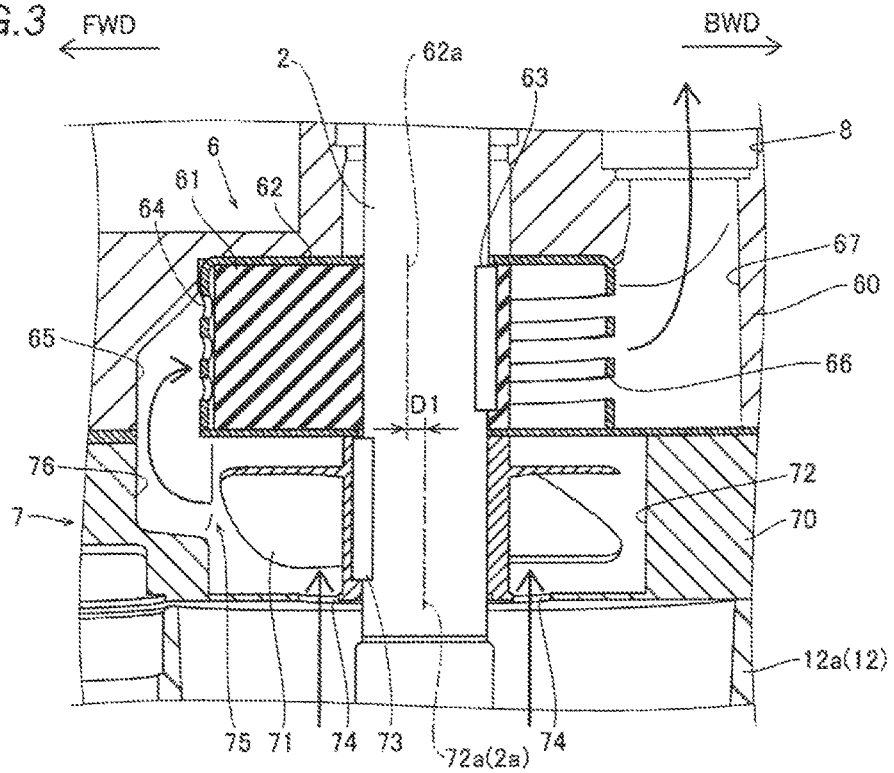
FIG. 3 is a sectional side elevational view showing the vicinity of a cooling water pump of the outboard motor according to a preferred embodiment of the present invention.
Figure 4:
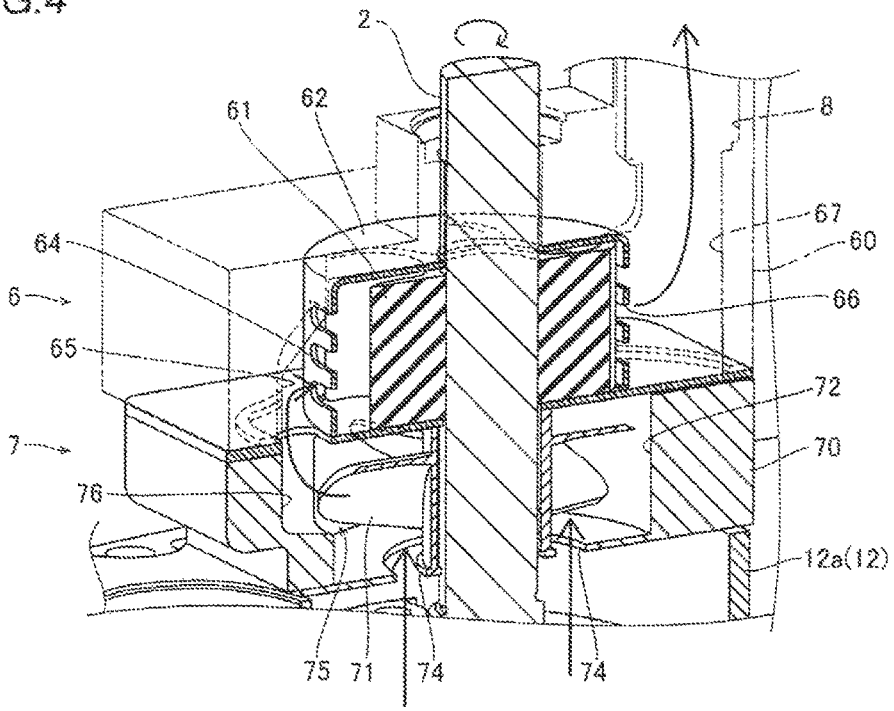
FIG. 4 is a perspective sectional view showing the vicinity of the cooling water pump of the outboard motor according to a preferred embodiment of the present invention.
Figure 5:
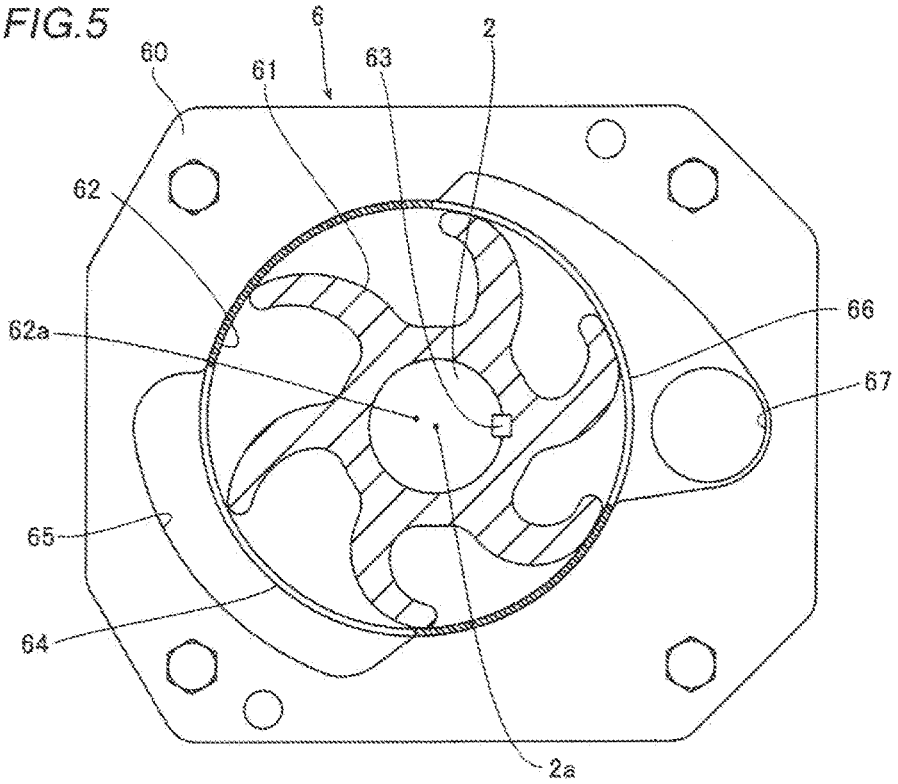
FIG. 5 is a schematic plan view for illustrating the structure of a first cooling water pump of the outboard motor according to a preferred embodiment of the present invention.

The first cooling water pump 6 includes a housing 60, an impeller 61, a pump case 62, a key 63, a suction port 64, a path 65, a discharge port 66, and a discharge path 67, as shown in FIGS. 3 to 5. The first cooling water pump 6 preferably includes a volume pump configured to pump the cooling water by a change in volume.

In the impeller 61, a plurality of upright wing portions are arranged at prescribed rotation angle intervals, as shown in FIGS. 4 and 5. This impeller 61 is preferably made of rubber, for example, and is configured to be elastically deformable. The impeller 61 is housed in the pump case 62 in a state where the wing portions are deformed. In other words, ends of the wing portions of the impeller 61 are in contact with the inner wall of the pump case 62. The impeller 61 is configured to rotate in an eccentric manner. In other words, the center 62*a* (the center of the pump case 62) of a rotation region of the impeller 61 and the center 2*a* of a rotation axis (drive shaft 2) of the impeller 61 are eccentric to each other in a plan view (as viewed in an axial direction), as shown in FIG. 5. The impeller 61 itself is preferably a non-eccentric turbine wheel configured to rotate about the center 2*a* of the rotation axis.

The impeller 61 engages with the drive shaft 2 through the key 63, as shown in FIGS. 3 and 5. Thus, the rotation motion of the drive shaft 2 is transmitted to the impeller 61.

The pump case 62 is cylindrical or substantially cylindrical. An outer peripheral portion of the pump case 62 is provided with the suction port 64 and the discharge port 66. Specifically, the suction port 64 is arranged in the outer peripheral portion of the pump case 62 at a position where the volume of a space divided by the pump case 62 and the wing portions of the impeller 61 is increased, as shown in FIG. 5. The discharge port 66 is arranged in the outer peripheral portion of the pump case 62 at a position where the volume of the space divided by the pump case 62 and the wing portions of the impeller 61 is reduced.

The path 65 is preferably integral with the housing 60, as shown in FIGS. 3 to 5. The path 65 is connected to the suction port 64. The discharge path 67 is preferably integral with the housing 60. The discharge path 67 is connected to the discharge port 66. The discharge path 67 is connected to the cooling water path 8.

According to a preferred embodiment of the present invention, the second cooling water pump 7 is arranged in a water passage upstream of the suction port 64 of the first cooling water pump 6 and is configured to apply pressure to cooling water supplied to the suction port 64 of the first cooling water pump 6. The second cooling water pump 7 is preferably configured to be driven by the driving force of the drive shaft 2. The second cooling water pump 7 is arranged on the upper surface of the lower case 12*a*. The second cooling water pump 7 is arranged in the upper case 11*a*.

Figure 6:
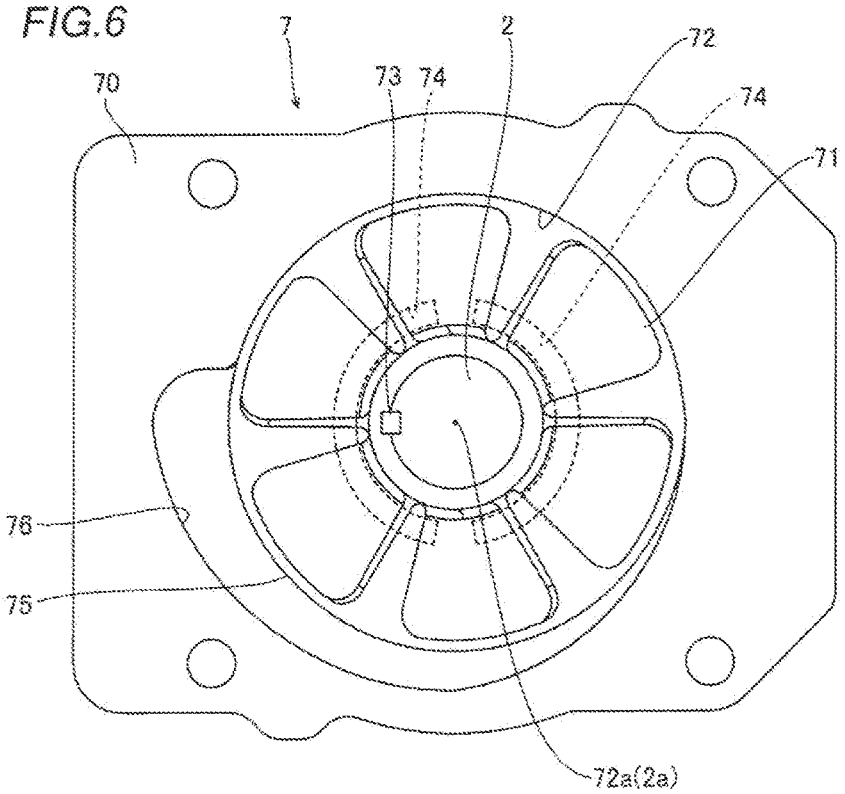
FIG. 6 is a schematic plan view for illustrating the structure of a second cooling water pump of the outboard motor according to a preferred embodiment of the present invention.

The second cooling water pump 7 includes a housing 70, a vaned wheel 71, a pump case 72, a key 73, a suction port 74, a discharge port 75, and a path 76, as shown in FIGS. 3, 4, and 6. The second cooling water pump 7 preferably includes a centrifugal pump, for example, configured to pump the cooling water by centrifugal force. The vaned wheel 71 is an example of the "pressurization mechanism" or the "rotating body" in a preferred embodiment of the present invention.

Figure 7:
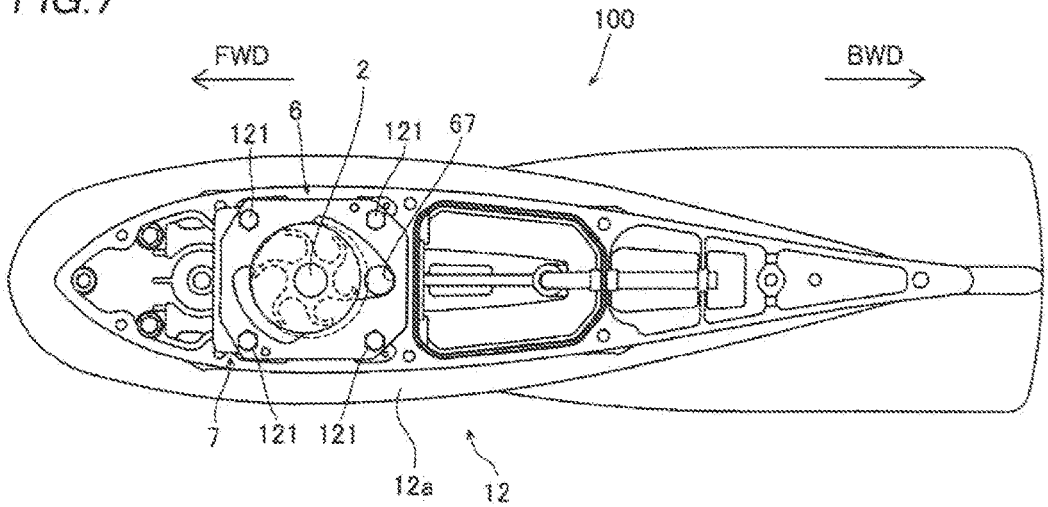
FIG. 7 is a top plan view of the lower portion of the outboard motor according to a preferred embodiment of the present invention mounted with the cooling water pump.

According to a preferred embodiment of the present invention, the second cooling water pump 7 and the first cooling water pump 6 are arranged in the vertical direction so as to overlap each other in the plan view of the outboard motor 100. In other words, the second cooling water pump 7 is arranged below the first cooling water pump 6. The second cooling water pump 7 is arranged between the lower case 12*a* (see FIG. 2) and the first cooling water pump 6. The second cooling water pump 7 and the first cooling water pump 6 are fixed to the upper surface of the lower case 12*a* by being fastened together by four common bolts 121, for example, as shown in FIG. 7, in a state where the second cooling water pump 7 and the first cooling water pump 6 are stacked in the vertical direction. The bolts 121 are examples of the "fastener member" in a preferred embodiment of the present invention.

In the vaned wheel 71, a plurality of wing portions inclined with respect to a horizontal direction are arranged at prescribed rotation angle intervals, as shown in FIGS. 4 and 6. This vaned wheel 71 is preferably made of metal such as SUS or aluminum, for example. In other words, the vaned wheel 71 of the second cooling water pump 7 preferably is made of a material harder than the material of the impeller 61 of the first cooling water pump 6, which is preferably made of rubber. The vaned wheel 71 is arranged inside the pump case 72 in an undeformed state, unlike the impeller 61.

Figure 8:
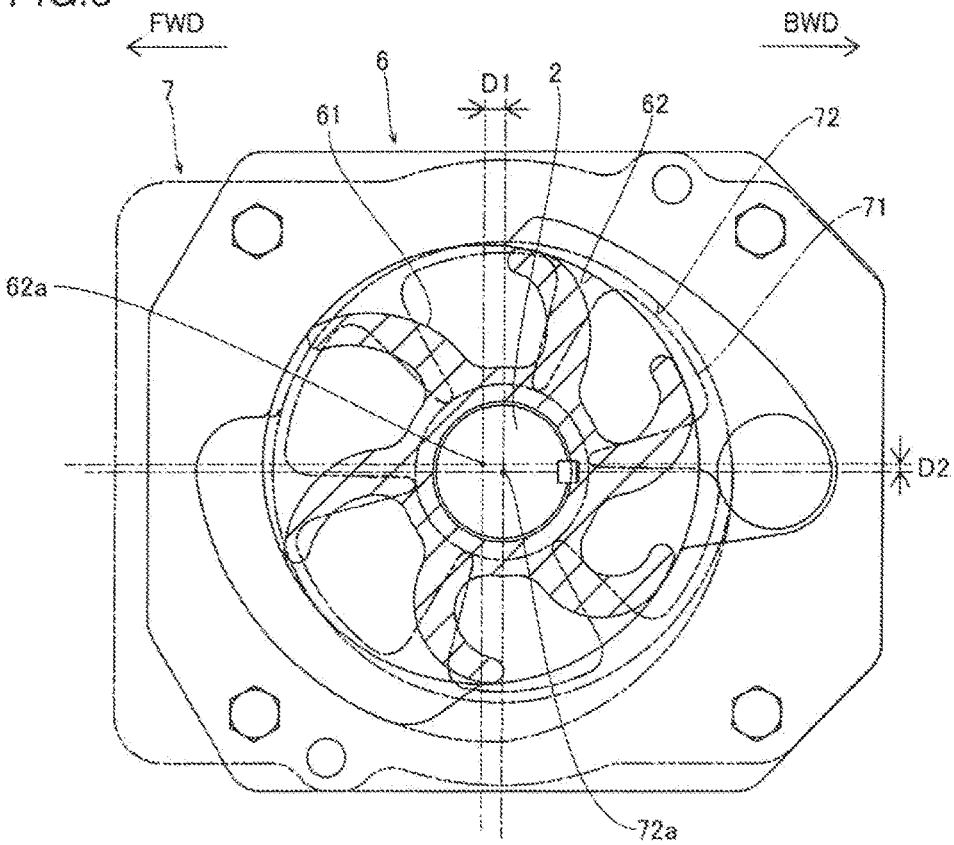
FIG. 8 is a plan view showing the first cooling water pump and the second cooling water pump of the outboard motor according to a preferred embodiment of the present invention.

As shown in FIG. 6, the center 72*a* (the center of the pump case 72) of a rotation region of the vaned wheel 71 is arranged at the same or substantially the same position as the center 2*a* of the rotation axis (drive shaft 2). As shown in FIG. 8, the center 62*a* (the center of the pump case 62) of the rotation region of the eccentric impeller 61 of the first cooling water pump 6 and the center 72*a* (the center of the pump case 72) of the rotation region of the vaned wheel 71 of the second cooling water pump 7 are preferably deviated from each other in the plan view. Specifically, the center 62*a* of the rotation region of the impeller 61 and the center 72*a* of the rotation region of the vaned wheel 71 are deviated from each other by a distance D1 in the front and back direction. The center 62*a* of the rotation region of the impeller 61 and the center 72*a* of the rotation region of the vaned wheel 71 are deviated from each other by a distance D2 smaller than the distance D1 in a transverse direction (a direction orthogonal or substantially orthogonal to the front and back direction). As shown in FIG. 3, the inner peripheral surface of the pump case 62 and the inner peripheral surface of the pump case 72 are deviated from each other in correspondence to the deviation (distance D1) between the centers (62*a* and 72*a*), as viewed from the side of a cross-section in the front and back direction, passing through the center 2*a* of the rotation axis.

The vaned wheel 71 engages with the drive shaft 2 through the key 73, as shown in FIGS. 3 and 6. Thus, the rotation motion of the drive shaft 2 is transmitted to the vaned wheel 71. The vaned wheel 71 is configured to rotate coaxially with the impeller 61 of the first cooling water pump 6.

The pump case 72 is cylindrical or substantially cylindrical. A lower portion of the pump case 72 is provided with the suction port 74. In other words, the suction port 74 is arranged in the rotation axis direction of the vaned wheel 71. An outer peripheral portion of the pump case 72 is provided with the discharge port 75.

The path 76 is preferably integral with the housing 70. The path 76 is connected to the discharge port 75. The path 76 is connected to the path 65 of the first cooling water pump 6, as shown in FIG. 4. In other words, the path 76 of the second cooling water pump 7 and the path 65 of the first cooling water pump 6 allow the discharge port 75 of the second cooling water pump 7 and the suction port 64 of the first cooling water pump 6 to communicate with each other.

The flow of the cooling water is now described. As shown in FIG. 1, the cooling water is taken in from intakes 8*a* and 8*b* provided in the lower case 12*a* and flows into the second cooling water pump 7. Then, the cooling water applied with pressure and discharged by the second cooling water pump 7 flows into the first cooling water pump 6. The cooling water discharged from the first cooling water pump 6 is sent to the engine 1 through the cooling water path 8. After the cooling water cools each portion of the engine 1, the cooling water is partially discharged as pilot water from a pilot water outlet 8*c* provided in an upper portion of the upper case 11*a*, and the rest is mixed with exhaust gas and is discharged from an outlet 8*d* located on the rear side of the propeller 5.

According to various preferred embodiments of the present invention, the following advantageous effects are obtained.

According to a preferred embodiment of the present invention, the second cooling water pump 7 (vaned wheel 71) applies pressure to the cooling water supplied to the suction port 64 of the first cooling water pump 6 and is provided in the water passage upstream of the suction port 64 of the first cooling water pump 6 such that the total power of the first cooling water pump 6 and the second cooling water pump 7 (vaned wheel 71) that pump the cooling water is increased by providing the second cooling water pump 7 (vaned wheel 71) without increasing the pump capacity of the first cooling water pump 6. Thus, the amount of discharged cooling water is increased. Furthermore, the pump capacity of the first cooling water pump 6 and the second cooling water pump 7 are not increased, and hence the first cooling water pump 6 and the second cooling water pump 7 are not increased in size in a radial direction. Therefore, an excessive increase in the flow velocity of the cooling water in the outer peripheral portions of the first cooling water pump 6 and the second cooling water pump 7 is significantly reduced or prevented, and hence the generation of cavitation is significantly reduced or prevented. Thus, a hindrance to increasing the amount of discharged cooling water is significantly reduced or prevented, and a reduction in the durability of the first cooling water pump 6 and the second cooling water pump 7 resulting from erosion is significantly reduced or prevented. Consequently, the amount of discharged cooling water is increased while the durability of the first cooling water pump 6 and the second cooling water pump 7 is maintained. In addition, the second cooling water pump 7 (vaned wheel 71) is provided such that the pressure of the cooling water sent to the first cooling water pump 6 is increased, and hence the generation of cavitation is effectively prevented. Consequently, in the case where the number of rotations of the first cooling water pump 6 is increased, the flow rate is easily increased, and erosion resulting from the generation of cavitation is effectively prevented.

According to a preferred embodiment of the present invention, the vaned wheel 71 of the second cooling water pump 7 is made of the material harder than the material of the impeller 61 of the first cooling water pump 6, which is preferably made of rubber. Thus, the vaned wheel 71 of the second cooling water pump 7 preferably is made of a material harder than the material of the impeller 61 such that the durability of the second cooling water pump 7 is improved, and hence damage of the vaned wheel 71 resulting from erosion is significantly reduced or prevented even when cavitation is generated on the upstream side (the side of the suction port 74 of the second cooling water pump 7) before pressure is applied to the cooling water. Furthermore, the length of the impeller 61 in the axial direction is not increased unlike the case where the length of the first cooling water pump 6 in the axial direction is increased to increase the pump capacity, and hence an increase in the torsion force in the axial direction of the impeller 61 made of rubber is significantly reduced or prevented. Thus, torsional deformation in the axial direction of the impeller 61 of the first cooling water pump 6, which is preferably made of rubber, is significantly reduced or prevented. Therefore, the durability of the first cooling water pump 6 is maintained.

According to a preferred embodiment of the present invention, the vaned wheel 71 of the second cooling water pump 7 is preferably made of metal, for example. Thus, the durability of the vaned wheel 71 of the second cooling water pump 7 is effectively improved.

According to a preferred embodiment of the present invention, the vaned wheel 71 of the second cooling water pump 7 is configured to rotate coaxially with the impeller 61 of the first cooling water pump 6. Thus, the drive axis of the second cooling water pump 7 and the drive axis of the first cooling water pump 6 are in common with each other, and hence an increase in the number of components is significantly reduced or prevented unlike the case where the drive axes are separate from each other.

According to a preferred embodiment of the present invention, the suction port 74 for the cooling water of the second cooling water pump 7 is arranged in the axis direction of the vaned wheel 71. Thus, the cooling water efficiently flows into the second cooling water pump 7 from the vicinity of the axial center (rotation axis) where the centrifugal force is small.

According to a preferred embodiment of the present invention, the discharge port 75 for the cooling water of the second cooling water pump 7 is arranged in the outer peripheral portion of the second cooling water pump 7. Thus, the cooling water is efficiently discharged from the outer peripheral portion where the centrifugal force is large.

According to a preferred embodiment of the present invention, the suction port 64 for the cooling water of the first cooling water pump 6 is arranged in the outer peripheral portion of the first cooling water pump 6. Thus, the cooling water is discharged from the outer peripheral portion of the second cooling water pump 7 and is allowed to flow into the first cooling water pump 6 through the outer peripheral portion of the first cooling water pump 6, and hence the structure of a path (flow path) for the cooling water is simplified.

According to a preferred embodiment of the present invention, the paths 65 and 76 that allow the discharge port 75 of the second cooling water pump 7 and the suction port 64 of the first cooling water pump 6 to communicate with each other are provided in the housing 70 of the second cooling water pump 7 and the housing 60 of the first cooling water pump 6. Thus, the paths 65 and 76 for the cooling water are preferably integral with the housing 70 of the second cooling water pump 7 and the housing 60 of the first cooling water pump 6, and hence an increase in the number of components is significantly reduced or prevented.

According to a preferred embodiment of the present invention, the center 62*a* of the rotation region of the eccentric impeller 61 of the first cooling water pump 6 and the center 72*a* of the rotation region of the vaned wheel 71 of the second cooling water pump 7 are preferably deviated from each other in the plan view. Thus, the center 62*a* of the rotation region of the eccentric impeller 61 of the first cooling water pump 6 and the center 72*a* of the rotation region of the vaned wheel 71 of the second cooling water pump 7 are deviated from each other by the eccentricity such that the axis of the impeller 61 of the eccentric pump (first cooling water pump 6) and the axis of the vaned wheel 71 of the second cooling water pump 7 are aligned with each other. Consequently, the first cooling water pump 6 and the second cooling water pump 7 are easily driven coaxially.

According to a preferred embodiment of the present invention, the first cooing water pump 6 and the second cooling water pump 7 are arranged in the vertical direction so as to overlap each other in the plan view. Thus, enlargement of the regions occupied by the first cooling water pump 6 and the second cooling water pump 7 is significantly reduced or prevented in the plan view of the outboard motor 100, and hence enlargement in the outboard motor 100 in the plan view is significantly reduced or prevented.

According to a preferred embodiment of the present invention, the second cooling water pump 7 is arranged below the first cooling water pump 6. Thus, the path (flow path) for the cooling water from the second cooling water pump 7 to the first cooling water pump 6 is provided from the lower side toward the upper side without meandering in the vertical direction, and hence an increase in the length of the flow path for the cooling water is significantly reduced or prevented. Thus, an increase in pressure loss is significantly reduced or prevented, and hence the flow rate of the cooling water is more effectively increased.

According to a preferred embodiment of the present invention, the first cooling water pump 6 and the second cooling water pump 7 are arranged on the upper surface of the lower case 12*a* of the outboard motor 100. Thus, during assembly or maintenance of the outboard motor 100, operations on the first cooling water pump 6 and the second cooling water pump 7 are easily performed in a state where the lower case 12*a* is detached.

According to a preferred embodiment of the present invention, the second cooling water pump 7 is arranged between the lower case 12*a* and the first cooling water pump 6 in the outboard motor 100. Thus, the second cooling water pump 7 is easily arranged below the first cooling water pump 6.

According to a preferred embodiment of the present invention, the first cooling water pump 6 and the second cooling water pump 7 are fixed to the upper surface of the lower case 12*a* of the outboard motor 100 by the common bolts 121 in a state where the first cooling water pump 6 and the second cooling water pump 7 are stacked in the vertical direction. Thus, the first cooling water pump 6 and the second cooling water pump 7 are easily mounted to each other, and hence a mounting operation is simplified.

The preferred embodiments of the present invention described above are illustrative in all points and not restrictive. The extent of the present invention is not defined by the above description of the preferred embodiments but by the scope of claims, and all modifications within the meaning and range equivalent to the scope of claims are further included.

For example, while the marine propulsion device according to a preferred embodiment described above is preferably applied to an outboard motor mounted on the outside of a boat, the present invention is not restricted to this. The marine propulsion device according to a preferred embodiment of the present invention may alternatively be applied to a propulsion device of a wet bike (personal watercraft) or to an inboard motor mounted on the inside of a boat.

While the pressurization mechanism according to a preferred embodiment described above preferably includes the second cooling water pump (vaned wheel) including the centrifugal pump, the present invention is not restricted to this. According to a preferred embodiment of the present invention, the pressurization mechanism may alternatively be a cooling water pump other than a centrifugal pump or other than a cooling water pump. For example, the pressurization mechanism may be a pressurization mechanism other than a pump provided with a rotating body. Alternatively, the pressurization mechanism may be a pump using a rotating body other than the vaned wheel. Alternatively, the pressurization mechanism may be a pressurization mechanism in which a mechanism other than a rotating body applies pressure to the cooling water. For example, the pressurization mechanism may be a pressurization mechanism including a mechanism configured to apply pressure to the cooling water by a reciprocating motion.

While the second cooling water pump according to a preferred embodiment described above is preferably a centrifugal type pump including the vaned wheel having the plurality of wing portions inclined with respect to the horizontal direction, the present invention is not restricted to this. According to a preferred embodiment of the present invention, the vaned wheel may alternatively have wing portions other than the wing portions inclined with respect to the horizontal direction. Furthermore, the second cooling water pump may alternatively be a positive-displacement pump including an impeller similar to that of the first cooling water pump.

While the vaned wheel of the second cooling water pump (pressurization mechanism) is preferably made of metal (SUS, aluminum, or the like, for example) in a preferred embodiment described above, the present invention is not restricted to this. According to a preferred embodiment of the present invention, the vaned wheel of the pressurization mechanism may alternatively be made of resin other than rubber. For example, the vaned wheel may be made of CFRP (carbon fiber reinforced plastic). Alternatively, the vaned wheel may be made of metal other than SUS and aluminum. In this case, the vaned wheel is preferably made of a material harder than the material of the impeller of the first cooling water pump.

While the second cooling water pump (pressurization mechanism) is preferably arranged below the first cooling water pump in a preferred embodiment described above, the present invention is not restricted to this. According to a preferred embodiment of the present invention, the pressurization mechanism may alternatively be arranged above the first cooling water pump, or the first cooling water pump and the pressurization mechanism may alternatively be arranged side by side.

While the suction port (position) for the cooling water of the second cooling water pump is preferably arranged in the axial direction of the vaned wheel (rotating body) in a preferred embodiment described above, the present invention is not restricted to this. According to a preferred embodiment of the present invention, the suction port (position) for the cooling water of the second cooling water pump may alternatively be arranged in the outer peripheral direction of the rotating body.

While the discharge port (position) for the cooling water of the second cooling water pump is preferably arranged in the outer peripheral direction of the vaned wheel (rotating body) in a preferred embodiment described above, the present invention is not restricted to this. According to a preferred embodiment of the present invention, the discharge port (position) for the cooling water of the second cooling water pump may alternatively be arranged in the axial direction of the rotating body.

While the suction port (position) and the discharge port (position) for the cooling water of the first cooling water pump are preferably arranged in the outer peripheral portion of the pump case in a preferred embodiment described above, the present invention is not restricted to this. According to a preferred embodiment of the present invention, the suction port (position) for the cooling water of the first cooling water pump may alternatively be arranged in the axial direction of the impeller, or the discharge port (position) for the cooling water of the first cooling water pump may alternatively be arranged in the axial direction of the impeller.

While the first cooling water pump and the second cooling water pump (pressurization mechanism) are preferably arranged adjacent to each other in the vertical direction in the a preferred embodiment described above, the present invention is not restricted to this. According to another preferred embodiment of the present invention, the first cooling water pump and the second cooling water pump (pressurization mechanism) may alternatively be separated from each other by a prescribed distance in the vertical direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

an engine;

a driving shaft coupled to the engine and configured to transmit power;

a first cooling water pump configured to be driven by a driving force of the driving shaft and to pump cooling water to cool the engine;

a cooling water path configured to supply the cooling water pumped by the first cooling water pump to the engine; and a pressurization mechanism arranged in a water passage upstream of a suction port of the first cooling water pump and configured to apply pressure to the cooling water supplied to the suction port of the first cooling water pump; wherein the pressurization mechanism includes a rotating body configured to be driven by the driving force of the driving shaft.

2. The marine propulsion device according to claim 1, wherein the rotating body of the pressurization mechanism includes a vaned wheel.

3. The marine propulsion device according to claim 2, wherein the first cooling water pump includes an impeller made of rubber, and the vaned wheel of the pressurization mechanism is made of a material harder than the rubber of the impeller of the first cooling water pump.

4. The marine propulsion device according to claim 3, wherein the vaned wheel of the pressurization mechanism is made of a resin other than rubber, or made of a metal.

5. The marine propulsion device according to claim 1, wherein the pressurization mechanism includes a second cooling water pump configured to apply pressure to the cooling water by rotation of the rotating body.

6. The marine propulsion device according to claim 1, wherein the rotating body of the pressurization mechanism is configured to rotate coaxially with an impeller of the first cooling water pump.

7. The marine propulsion device according to claim 1, wherein the pressurization mechanism includes a suction port, and the suction port of the pressurization mechanism is arranged in an axial direction of the rotating body.

8. The marine propulsion device according to claim 1, wherein the pressurization mechanism includes a suction port, and the suction port of the pressurization mechanism is arranged in an outer peripheral portion of the pressurization mechanism.

9. The marine propulsion device according to claim 8, wherein a housing of the pressurization mechanism and a housing of the first cooling water pump are provided with a path configured to allow a discharge port of the pressurization mechanism and the suction port of the first cooling water pump to communicate with each other.

10. The marine propulsion device according to claim 1, wherein the suction port of the first cooling water pump is arranged in an outer peripheral portion of the first cooling water pump.

11. The marine propulsion device according to claim 1, wherein the first cooling water pump includes an impeller configured to rotate in an eccentric manner, and a center of a rotation region of the impeller and a center of a rotation region of the rotating body in the pressurization mechanism are deviated from each other in a plan view of the marine propulsion device.

12. The marine propulsion device according to claim 1, wherein the first cooling water pump and the pressurization mechanism are arranged in a vertical direction so as to overlap each other in a plan view of the marine propulsion device.

13. The marine propulsion device according to claim 12, wherein the pressurization mechanism is arranged below the first cooling water pump.

14. The marine propulsion device according to claim 1, wherein the first cooling water pump and the pressurization mechanism are arranged on an upper surface of a lower case of the marine propulsion device.

15. The marine propulsion device according to claim 14, wherein the pressurization mechanism is arranged between the lower case of the marine propulsion device and the first cooling water pump.

16. The marine propulsion device according to claim 14, wherein the first cooling water pump and the pressurization mechanism are fixed to the upper surface of the lower case of the marine propulsion device by a common fastener member in a state where the first cooling water pump and the pressurization mechanism are stacked in a vertical direction.

17. A marine propulsion device comprising:

an engine;

a driving shaft coupled to the engine and configured to transmit power;

a cooling water pump configured to be driven by a driving force of the driving shaft and to pump cooling water to cool the engine;

a cooling water path configured to supply the cooling water pumped by the cooling water pump to the engine; and a vaned wheel arranged in a water passage upstream of a suction port of the cooling water pump.

18. A marine propulsion device comprising:

an engine;

a driving shaft coupled to the engine and configured to transmit power;

a first cooling water pump configured to be driven by a driving force of the driving shaft and to pump cooling water to cool the engine;

a cooling water path configured to supply the cooling water pumped by the first cooling water pump to the engine; and a second cooling water pump arranged in a water passage upstream of a suction port of the first cooling water pump.

* * * * *